United States Patent [19]

Herod et al.

[11] 4,422,635

[45] Dec. 27, 1983

[54] PORTABLE MULTIPLE USE EXERCISER

[76] Inventors: James V. Herod, P.O. Box 1317, Collegedale, Tenn. 37315; Charles H. Neal, 2027 Jenkins Rd., Chattanooga, Tenn. 37421

[21] Appl. No.: 344,203

[22] Filed: Jan. 27, 1982

[51] Int. Cl.[3] ..... A63B 23/04; A61G 7/04

[52] U.S. Cl. ..... 272/96; 272/900; 248/464

[58] Field of Search ..... 272/96, 140, 135, 93; 248/441 B, 441 C, 464, 460; 108/6

[56] References Cited

U.S. PATENT DOCUMENTS

| | | | |
|---|---|---|---|
| 1,020,777 | 3/1912 | Peterson | 108/6 |
| 2,374,730 | 5/1945 | Catlin | 272/96 |
| 2,427,761 | 9/1947 | Bull | 272/96 |
| 3,297,320 | 1/1967 | Benedetto | 272/93 |
| 3,524,643 | 8/1970 | Hazelitt | 272/96 |
| 3,652,051 | 3/1972 | McFarlane | 248/464 |
| 3,741,540 | 6/1973 | Shimizu | 272/96 |
| 3,942,791 | 3/1976 | Dawson | 272/96 |
| 4,111,416 | 9/1978 | Jinotti | 272/96 |
| 4,253,661 | 3/1981 | Russel | 272/70 |

FOREIGN PATENT DOCUMENTS

| | | | |
|---|---|---|---|
| 2145884 | 3/1973 | Fed. Rep. of Germany | 272/96 |

*Primary Examiner*—Richard J. Johnson
*Attorney, Agent, or Firm*—Harvey B. Jacobson

[57] ABSTRACT

A generally horizontal base is provided and a pair of side-by-side elongated levers are pivotally supported at one pair of corresponding ends from the base for independent oscillation relative to the base between first positions generally paralleling the base and second positions angled relative to the base with the other ends of the levers inclined away from the base. Spring structure is connected between the levers and the base for yieldingly biasing the levers toward the second positions thereof, latch structure is provided and engageable with the levers to releasably retain the levers in the first positions thereof and a stand is provided for the base including a generally horizontal panel including opposite side marginal portions and a pair of wings pivotally supported from the marginal portions of the panel for swinging movement between collapsed positions generally paralleling and overlying the panel and extended limit positions with the wings disposed in upwardly projecting positions disposed at generally right angles relative to the panel. The free swinging edges of the wings are similarly inclined relative to the axes of oscillation of the wings and include first "Velcro" type fastening structure while the underside surfaces of the opposite marginal portions of the base include second "Velcro" type fastening structure. The first fastening structure is releasably engageable with the second fastener structure, whereby the base is removably supported from the stand in an inclined position.

8 Claims, 10 Drawing Figures

PORTABLE MULTIPLE USE EXERCISER

BACKGROUND OF THE INVENTION

It has recently been appreciated that many bed patients recuperating from operations and extended periods of immobility may experience considerably shorter recovery periods if blood circulation throughout the various extremities of the body, and thus also the torso of the body, is increased. Further, although it was previously known that increased blood circulation would tend to shorten periods of convalescence, exercise of convalescent patients was generally postponed until those patients could arise from their beds and walk about their rooms or along corridors of hospitals and the like. Accordingly, many patients who are physically disabled to the extent that they may not arise from their beds and walk about, but who are otherwise physically able to perform exercise movements, do not obtain the benefits of increased blood circulation attendant with exercise movements until they are ready to arise from their beds. Therefore, a need exists for an exercise apparatus which may be used by bedridden patients to exercise substantially all of the portions of the body that are not immobilized due to injury.

Further, a need exists for an exerciser which may be used during normal rest periods of the user such as when seated in a chair or lying in bed in order to exercise various extremities of the body and thereby increase circulation in those extremities and also within the torso.

Examples of various forms of exercising devices including some of the structural and operational features of the instant invention are disclosed in U.S. Pat. Nos. 2,374,730, 2,830,816, 3,297,320, 3,741,540, 3,814,420, 3,942,791, 4,111,416, 4,253,661 and 4,279,415.

BRIEF DESCRIPTION OF THE INVENTION

The exerciser of the instant invention has not been designed primarily for the purpose of exercising and thus building up normal body muscles, but for light exercise of weakened muscles and more importantly to enable exercise of the extremities of bedridden patients primarily for the purpose of increasing blood circulation throughout the patient's body.

The main object of this invention is to provide an exercising apparatus which may be actuated by the user while seated in a chair, while lying in bed, while seated behind a desk, while lying on the floor or while reclining in a recliner chair.

Another object of this invention is to provide an exercise apparatus which may be utilized to exercise body extremities having weakened muscles and which has been specifically designed as as aid to increased blood circulation.

A further object of this invention is to provide an exerciser in accordance with the preceding objects and which may be readily transported from one place to another and stored in a compact state.

Still another object of this invention is to provide an exerciser in accordance with the preceding objects and constructed in a manner whereby it may be used not only in the home or in an office, but also in hospitals.

A final object of this invention to be specifically enumerated herein is to provide an exercising apparatus in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
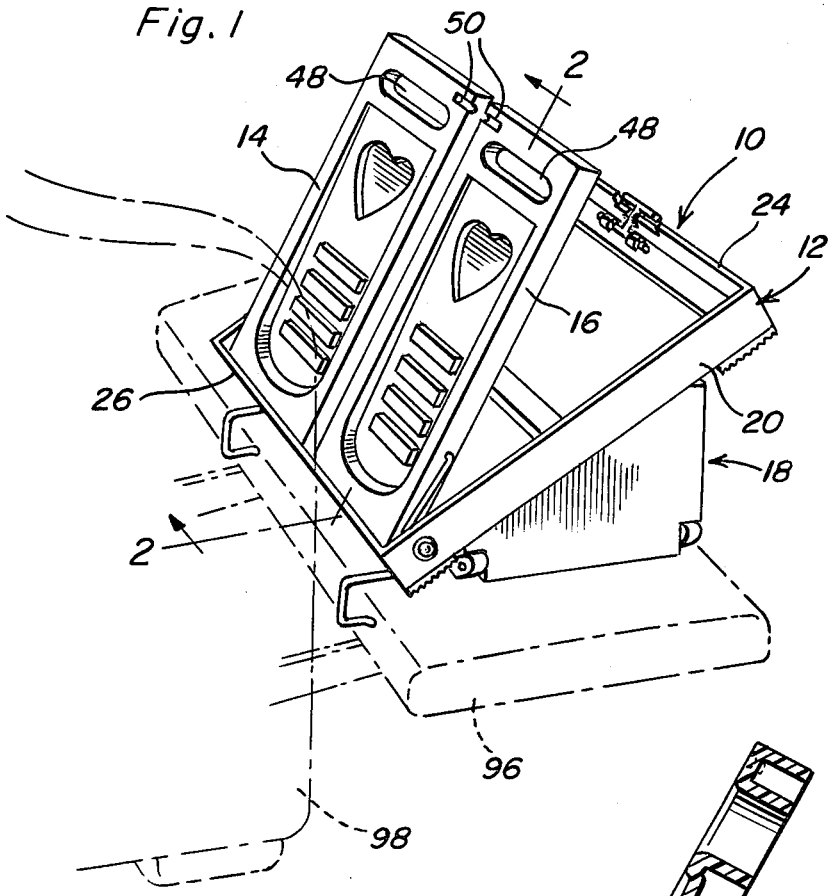
FIG. 1 is a perspective view of the exerciser of the instant invention including the stand thereof for supporting the base of the exerciser in an inclined position and with the stand for the base illustrated supported from the raised leg rest of a recliner chair illustrated in phantom lines.

With attention now invited more specifically to the drawings, the numeral 10 generally designates the portable exerciser of the instant invention. The exerciser 10 includes a one-piece plastic base referred to in general by the reference numeral 12, a pair of elongated levers or treadles 14 and 16 pivotally supported from the base 12 and a collapsible stand referred to in general by the reference numeral 18 from which the base 12 may be removably supported.

Figure 9:
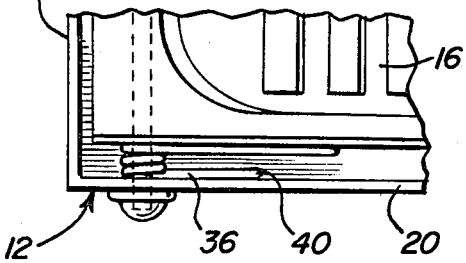
FIG. 9 is a fragmentary planned view of the lower central corner portion of the assemblage illustrated in FIG. 6 on somewhat of an enlarged scale.

The base 12 is in the form of an open rectangular frame including opposite sides 20 and 22 and front and rear transverse members 24 and 26 extending between and interconnecting the front and rear ends of the sides 20 and 22. The elements 20, 22, 24 and 26 are generally L-shaped in cross section and the central portion of the transverse member 26 includes a forwardly projecting integral boss 30 for the purpose to be hereinafter more fully set forth. In addition, the base 12 defines an upwardly opening recess 32 and corresponding ends of the treadles 14 and 16 are pivotally supported within the recess 32 through the utilization of a pivot shaft 34 extending through the rear ends of the sides 20 and 22, the boss 30 and the rear ends of the treadles 14 and 16. A pair of butterfly springs 36 are disposed about opposite ends of the shaft 34 inwardly of the upstanding portions of the sides 20 and 22 and include first end portions anchored to the treadles 14 and 16 as at 38 (see FIG. 3) and abuttingly engaged with the corresponding sides 20 and 22 as at 40, see FIGS. 2 and 9.

Figure 2:
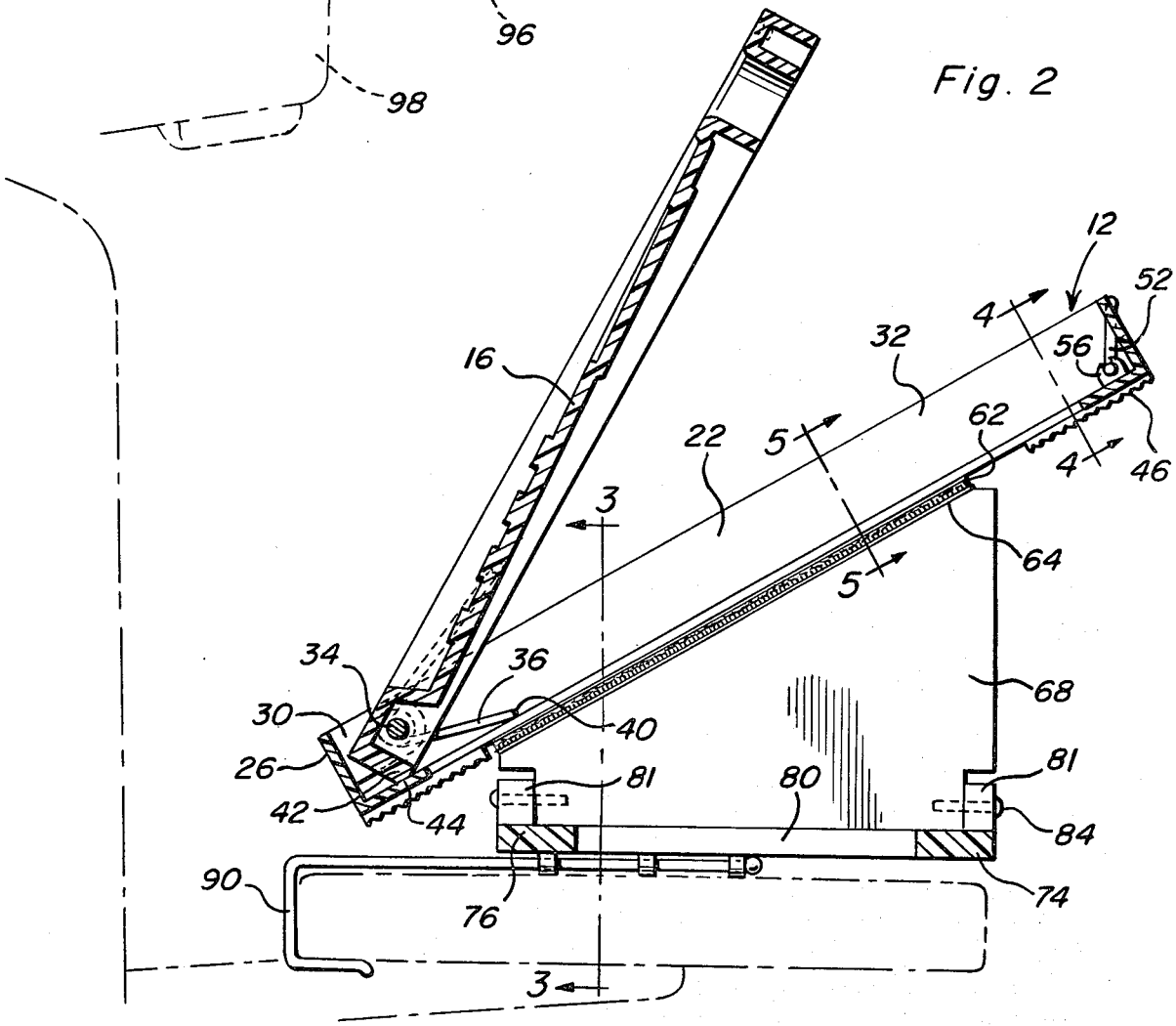
FIG. 2 is an enlarged vertical sectional view taken substantially upon the plane indicated by the section line 2—2 of FIG. 1.
Figure 3:
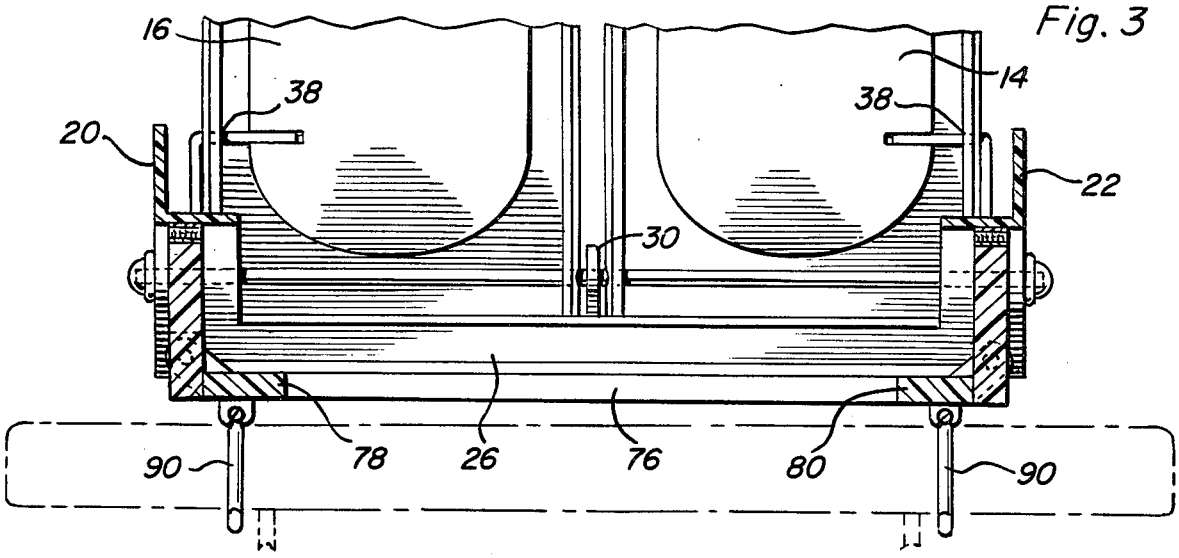
FIG. 3 is a fragmentary vertical sectional view taken substantially upon the plane indicated by the section line 3—3 of FIG. 2.
Figure 6:
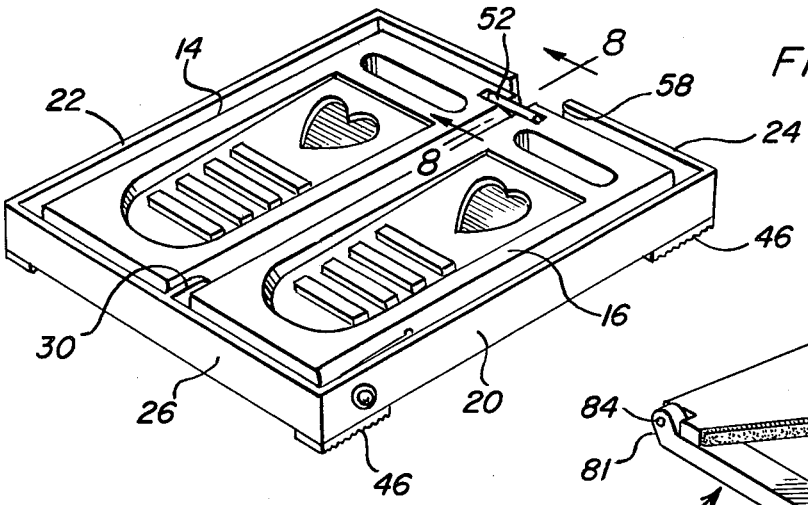
FIG. 6 is a perspective view of the base, lever or treadle portion of the invention with the lever portions latched in their inoperative positions.

The treadles 14 and 16 are swingable between first retracted positions received within the recess 32 and paralleling the base 12 as illustrated in FIG. 6 and second raised inclined positions such as those illustrated in FIGS. 1, 2 and 3 with the heel ends 42 of the treadles 14 and 16 engaging the corresponding opposite ends of the horizontal component of the rear transverse member 26 AS at 4, see FIG. 2. Accordingly, the retracted horizontal positions of the treadles 14 and 16 illustrated in FIG. 6 comprise one pair of limit positions of movement of the treadles 14 and 16 and the raised inclined positions of the treadles 14 and 16 illustrated in FIGS. 1, 2 and 3 illustrate the other limit positions of movement of the treadles 14 and 16.

Figure 4:
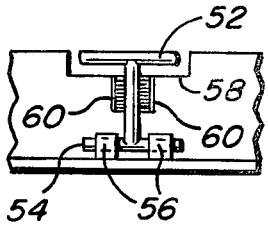
FIG. 4 is a fragmentary elevational view of a portion of the lever or treadle locking mechanism as seen from the section line 4—4 of FIG. 2.
Figure 5:
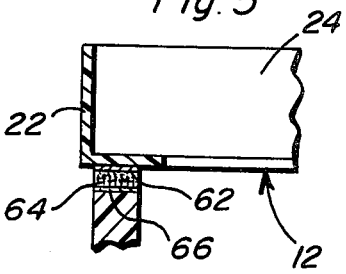
FIG. 5 is a fragmentary vertical sectional view taken substantially upon the plane indicated by the section line 5—5 of FIG. 2.

The four corner portions of the base 12 include low silhouette depending feet 46 having roughened undersurfaces for frictionally gripping various surfaces upon which the base 12 may be placed and the free ends of the treadles 14 and 16 include handgrip openings 48 whereby the free swinging ends of the treadles 14 and 16 may be gripped by the hands of the user. Also, adjacent marginal edges of the forward ends of the treadles 14 and 16 include recesses 50 in which the opposite end portions of a T-shaped latch 52 may be engaged in order to retain the treadles 14 and 16 in their retracted positions illustrated in FIG. 6. The end of the latch remote from the T-head 52 thereof includes a cross head 54 snap-engaged with and pivotally supported from integral mounting journal portions 56 carried by the horizontal component of the forward transverse member 24, see FIGS. 2 and 4. Further, the free edge of the upstanding component of the transverse member 24 includes an upwardly opening recess 58 formed therein and a pair of inwardly projecting integral bosses 60 below the recess 58 between which the latch 52 may be snap-engaged when the exerciser 10 is in use to maintain the latch 52 in a position which will not interfer with swinging movement of the treadles 14 and 16 toward and away from the fully recess or collapsed positions thereof illustrated in FIG. 6.

The undersurfaces of the opposite sides 20 include strips 62 of a first type of "Velcro" fastener and a pair of strips 64 of a second type of "Velcro" fastener are carried by the free swinging angled edges 66 of a pair of wings 68 pivotally supported from a supporting panel 70 of a stand referred to in general by the reference numeral 72. The panel 70 is in the form of an open frame including front and rear transverse members 74 and 76 interconnected by opposite side side members 78 and 80 extending therebetween. The panel 70 is of one-piece construction and the opposite ends of the front and rear transverse members 74 and 76 include upwardly and outwardly angled mounting ears 81 between which the base marginal edges 82 of the wings 68 are pivotally mounted by pivot pins 84.

Figure 7:
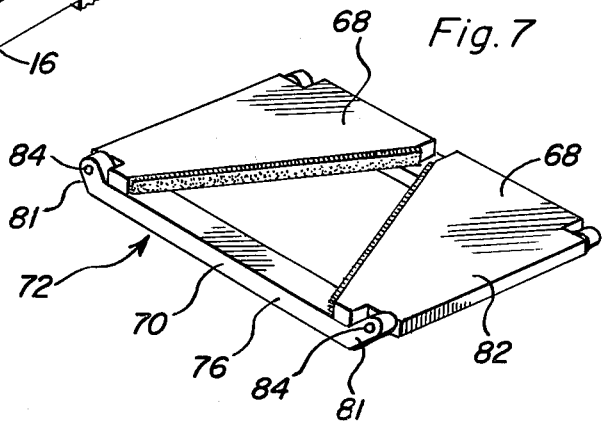
FIG. 7 is a perspective view of the stand portion of the invention with the pivoted wings thereof in a collapsed position.
Figure 8:
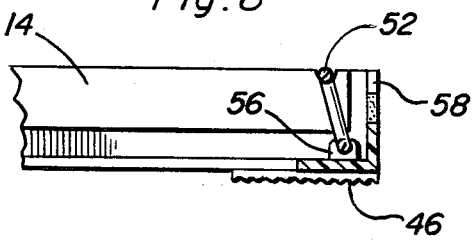
FIG. 8 is a fragmentary vertical sectional view taken substantially upon the plane indicated by the section line 8—8 of FIG. 6.

From FIGS. 7 and 8 of the drawings, it may be seen that the wings 68 may be swung between fully collapsed positions closing overlying the panel 70 and substantially upright positions with the base edge portions 82 of the wings abuttingly engaged with the outer side edges of the side members 78. After the wings 68 have been opened or extended to the positions thereof illustrated in FIGS. 1, 2, 3 and 10, the "Velcro" strips 62 and 64 may be engaged with each other while the free swinging edges of the wings 68 are slightly biased apart. By securing the stand 72 to the base 12 in this manner, the base 12 is rigidly supported from the stand 18 and the latter may be placed upon any suitable supporting surface. In addition, the the underside of the panel 70 includes a pair of opposite side J-shaped hooks 90 rotatably and slidably supported from journal defining projections 92 formed integrally with and depending downwardly from the underside of the side members 78 and 80 and the J-shaped hooks may be retained in collapsed positions by integral projections 94 illustrated in FIG. 10 with which the J-shaped hooks 90 may be snap-engaged. When the hooks 90 are in extended positions such as those illustrated in FIGS. 1, 2 and 3 of the drawings, the hooks 90 are positioned to engage, and support the stand 72 from, the retractable leg support 96 of a recliner chair 98.

In operation, exerciser 10, with only the base 12 and the treadles 14 and 16 being used, may be positioned on the floor in front of a seated person and that person, after releasing the latch 52, may use his legs and feet to alternately depress and release the treadles 14 and 16. This depression may be carried out either through utilization of the legs along or by rocking the feet in a pitch mode. The springs 36 are not excessively strong and therefore do not render the exerciser primarily as a muscle developing exerciser. Rather, the weak strength springs enable persons to exercise their legs and their feet in order to increase blood circulation therein and thus throughout the rest of the body. In addition, people who have been bedridden for long periods of time may utilize the exerciser in this manner in order to prevent leg and foot muscles from becoming weakened or the exerciser 10 may be utilized to somewhat strengthen weakened muscles.

In addition, a person lying in bed may place the frame across his lower torso and engage the handgrip openings 48 of the treadles 14 and 16 in order to exercise his arms and thus increase circulation therein. Further, the treadles 14 and 16 may be engaged by the elbows of a user in generally the same manner to exercise the upper arm portions. Still further, the exerciser 10 may be used in conjunction with the stand 18 in the manner illustrated in FIGS. 1, 2 and 3 of the drawings in order to exercise the legs and/or feet of a user seated in the chair 98. Still further, the exerciser 10 may also be used in conjunction with the stand 18 when the hooks 90 thereof are retracted in the manner illustrated in FIG. 10 of the drawings and the panel 70 is disposed flat on the lower portion of a bed upon which the user of the exerciser 10 is lying down.

When the treadles 14 and 16 are in the retracted positions thereof illustrated in FIG. 6, the handgrip openings 48 may be used in carrying the base 12 and treadles 14 and 16. Of course, the stand 72 may also be readily carried when it is in the collapsed position illustrated in FIG. 7.

Figure 10:
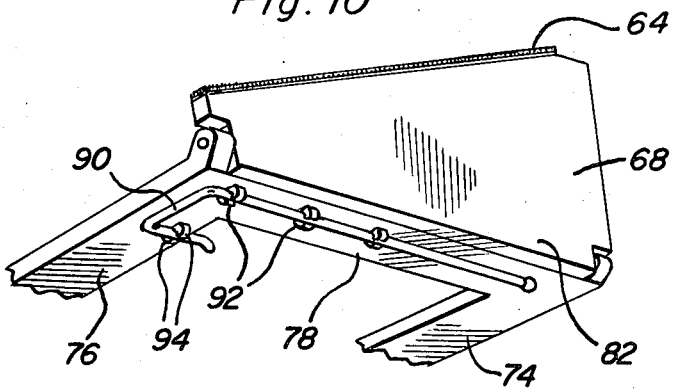
FIG. 10 is a fragmentary underside perspective view of the stand portion of the invention illustrating the manner in which the legs supporting gripping hooks carried by the stand portion may be retained in collapsed positions.

The upwardly and outwardly inclined ears 81 are used in order that the entire lower marginal portions 82 of the wings 68 may abut against the remote sides of the side members 78 in order to define positive limits of swinging movement of the wings 68 to the extended positions thereof illustrated in FIG. 10. After being pivoted to the extended positions, the wings 68 may be anchored relative to the strips 62 in the aforementioned manner while the upper free swings edges of the wings 68 carrying the strips 64 are slightly outwardly flexed. This results in the connection between the stand 72 and the base 12 being effectively rigidified.

All of the components of the exerciser 10 with the possible exception of the shaft 34, the pivot pins 84 and the hooks 90 may be constructed of plastic. Accordingly, the exerciser 10 may be readily mass produced at an extremely low cost.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A portable multiple use exerciser including a base, a pair of side-by-side levers pivotally supported at one pair of corresponding ends from said base for independent spring biased oscillation relative to said base between first positions generally paralleling said base and second positions angled relative to said base with the other ends of said levers inclined away from said base, said levers being adapted to be engaged by the feet, hands, knees or elbows of the user, a stand for said base, said base including opposite side marginal portions generally paralleling said levers when the latter are in the first positions thereof, said stand including a support panel having opposite side marginal portions, a pair of wings pivotally supported from said opposite side marginal portions of said panel for swinging movement relative thereto about an axis generally paralleling said side marginal portions and between collapsed positions generally paralleling and overlying one side of said panel and extended limit positions with said wings disposed at generally right angles relative to said panel and projecting outwardly of one side thereof, the free swinging edge portions of said wings being similarly inclined relative to said axes and including first fastening means supported therefrom, the undersurfaces of said opposite side marginal portions of said base including second fastening means supported therefrom with which said first fastening means are releasably engageable for supporting said base in an inclined position relative to a surface upon which said panel rests.

2. The exerciser of claim 1 including spring means yieldingly biasing said levers toward the second positions thereof.

3. A portable multiple use exerciser including a base, a pair of side-by-side levers pivotally supported at one pair of corresponding ends from said base for independent oscillation relative to said base between first positions generally paralleling said base and second positions angled relative to said base with the other ends of said levers inclined away from said base, said levers being adapted to be engaged by the feet, hands, knees or elbows of the user, spring means yieldingly biasing said levers toward the second positions thereof, a stand for said base, said base including opposite side marginal portions generally paralleling said levers when the latter are in the first positions thereof, said stand including a support panel having opposite side marginal portions, a pair of wings pivotally supported from said opposite side marginal portions of said panel for swinging movement relative thereto about an axis generally paralleling said side marginal portions and between collapsed positions generally paralleling and overlying one side of said panel and extended limit positions with said wings disposed at generally right angles relative to said panel and projecting outwardly of said one side thereof, the free swinging edges of said wings being similarly inclined relative to said axes and including first "Velcro" type fastening means thereon, the undersurfaces of said opposite side marginal portions of said base including second "Velcro" type fastening means thereon with which said first fastening means are releasably engageable for supporting said base in an inclined position relative to a surface upon which said panel rests.

4. The exerciser of claim 3 including latch means operative to releasably retain said treadles in the first positions thereof.

5. The exerciser of claim 3 wherein said panel includes retractable hooks for engagement with one marginal edge of a panel member upon which said panel may be placed.

6. The exercise of claim 5 including latch means operative to releasably retain said treadles in the first positions thereof.

7. The exerciser of claim 3 wherein said base defines a generally horizontal upwardly opening recess in which said levers are recessed when said levers are in the first positions thereof.

8. The exerciser of claim 3 wherein the other pair of ends of said levers include handgrip openings formed therein.

* * * * *